US009341173B2

(12) United States Patent
Laughlin et al.

(10) Patent No.: US 9,341,173 B2
(45) Date of Patent: May 17, 2016

(54) LANCE PUMP WITH A RAM

(75) Inventors: Henry Laughlin, St. Louis, MO (US); Paul G. Conley, St. Charles, MO (US)

(73) Assignee: Lincoln Industrial Corporation, St. Louis, MO (US)

( * ) Notice: Subject to any disclaimer, the term of this patent is extended or adjusted under 35 U.S.C. 154(b) by 909 days.

(21) Appl. No.: 13/331,217

(22) Filed: Dec. 20, 2011

(65) Prior Publication Data

US 2013/0156621 A1 Jun. 20, 2013

(51) Int. Cl.
*F04B 19/02* (2006.01)
*F04B 23/02* (2006.01)
*F04B 53/12* (2006.01)

(52) U.S. Cl.
CPC ..... *F04B 19/022* (2013.01); *F04B 23/028* (2013.01); *F04B 53/126* (2013.01)

(58) Field of Classification Search
CPC .... F04B 19/022; F04B 39/0016; F04B 23/02; F04B 23/023
USPC ..... 417/547, 554, 555.1, 555.2, 460, 469; 92/181 R, 183
See application file for complete search history.

(56) References Cited

U.S. PATENT DOCUMENTS 2,187,684 A 1/1940 Fox et al.
2,569,110 A 9/1951 McGillis et al.
2,636,441 A 4/1953 Woelfer
2,787,225 A 4/1957 Rotter
3,113,282 A 12/1963 Coleman
3,409,165 A 11/1968 Creith
3,437,771 A 4/1969 Nusbaum
3,469,532 A 9/1969 Wegmann et al.
3,502,029 A 3/1970 Halladay
3,510,234 A 5/1970 Wolf
3,945,772 A 3/1976 Van de Moortele
4,243,151 A 1/1981 Bruening
4,249,868 A 2/1981 Kotyk
4,487,340 A 12/1984 Shaffer
4,575,313 A 3/1986 Rao et al.
4,718,824 A 1/1988 Cholet et al.
4,735,048 A * 4/1988 Gregory ..... 60/478
4,762,474 A 8/1988 Dartnall (Continued)

FOREIGN PATENT DOCUMENTS

DE 19623537 A1 12/1997
WO 9641136 A1 12/1996

OTHER PUBLICATIONS

PCT International Search Report for PCT/US2012/070108 dated Feb. 15, 2013, 4 pages.

(Continued)

*Primary Examiner* — Devon Kramer
*Assistant Examiner* — Kenneth J Hansen
(74) *Attorney, Agent, or Firm* — Senniger Powers LLP

(57) ABSTRACT

An improved lance pump is disclosed for pumping a pumpable product, particularly lubricant including grease, from a lubricant supply. The pump comprises a head for placement above the supply, a tubular lance structure affixed to the head and extending down into the supply, and a pump tube inside the lance structure that is reciprocated up and down for pumping lubricant from the supply on both upstrokes and downstrokes of the tube. A ram at a lower end of the lance structure is positioned for forcing lubricant up into the tube and past an inlet check valve on a downstroke of the tube.

14 Claims, 13 Drawing Sheets

(56) References Cited

U.S. PATENT DOCUMENTS

| | | | |
|---|---|---|---|
| 5,022,556 | A | 6/1991 | Dency et al. |
| 5,025,827 | A | 6/1991 | Weng |
| 5,178,405 | A | 1/1993 | Brandstadter |
| 5,188,519 | A | 2/1993 | Spulgis |
| 5,685,331 | A | 11/1997 | Westermeyer |
| 5,725,358 | A | 3/1998 | Bert et al. |
| 5,850,849 | A | 12/1998 | Wood |
| 6,102,676 | A | 8/2000 | DiCarlo et al. |
| 6,161,723 | A | 12/2000 | Cline et al. |
| 6,863,502 | B2 | 3/2005 | Bishop et al. |
| 6,886,589 | B2 | 5/2005 | Oretti |
| 2003/0206805 | A1 | 11/2003 | Bishop et al. |
| 2007/0253848 | A1 | 11/2007 | Lea, Jr. |
| 2007/0289994 | A1 | 12/2007 | Kotyk |
| 2008/0240944 | A1 | 10/2008 | Arens |

OTHER PUBLICATIONS

Written Opinion for PCT/US2012/070108 dated Feb. 15, 2013, 6 pages.

International Search Report regarding corresponding PCT/US2013/030464, dated Sep. 27, 2013, 4 pages.

Written Opinion of the International Searching Authority, PCT/2013/030464, dated Sep. 27, 2013, 7 pages.

* cited by examiner

LANCE PUMP WITH A RAM

FIELD OF THE INVENTION

This invention relates to pumps, and more particularly to an expansible chamber pump of a type which may be referred to as a lance pump, particularly adapted for pumping lubricant, including grease, from a supply thereof (e.g. lubricant in a drum).

BACKGROUND OF THE INVENTION

The pump of this invention is in the same field as the pumps shown in the following U.S. Pat. Nos. 2,187,684, 2,636,441, 2,787,225, 3,469,532, 3,502,029, 3,945,772, 4,487,340, 4,762,474, and 6,102,676, the latter of which is directed to a lance pump sold by Lincoln Industrial Corporation of St. Louis, Mo. under the trademark Flow Master®. While the Flow Master® pump has proven to be commercially successful, there is a need for increasing the output of the pump when the pump is used to pump stiff greases.

SUMMARY OF THE INVENTION

This invention is directed to an improved lance pump for pumping a pumpable product, particularly lubricant including grease, from a supply thereof. The pump comprises a head adapted for placement above the supply, and an elongate member constituting a plunger extending down from the head having an upper end and a lower end. The plunger is fixed at its upper end with respect to the head. An elongate tube surrounds the plunger and extends down from adjacent the upper end of the plunger to and below the lower end of the plunger and is reciprocal up and down through a pump stroke relative to the plunger. A motor-driven mechanism associated with the head reciprocates the tube through its pump stroke between a raised position relative to the plunger and a lowered position relative to the plunger. The tube has an upper end closure slidable up and down on an upper portion of the plunger. The tube also has a lower end closure slidable up and down on a lower portion of the plunger. An elongate annular pump chamber is provided between the plunger and the tube. The tube has an inlet check valve adjacent an open lower end of the tube and below a lower end of the plunger defining in conjunction with the lower end of the plunger an expansible and contractible lower end chamber. The inlet check valve opens on a downstroke of the tube for entry of the pumpable product to the lower end chamber. The tube has a first passage for outflow of pumpable product from the elongate annular pump chamber to and through an outlet in the head on a downstroke and also on an upstroke of the tube. The tube also has a second passage with a check valve therein adapted to open on each upstroke of the tube with the inlet check valve closed for delivery of pumpable product from the lower end chamber to the elongate annular pump chamber. A tubular lance structure is affixed to the head and surrounds the tube. A ram at a lower end of the lance structure is positioned for forcing lubricant up into the tube past the inlet check valve on a downstroke of the tube.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
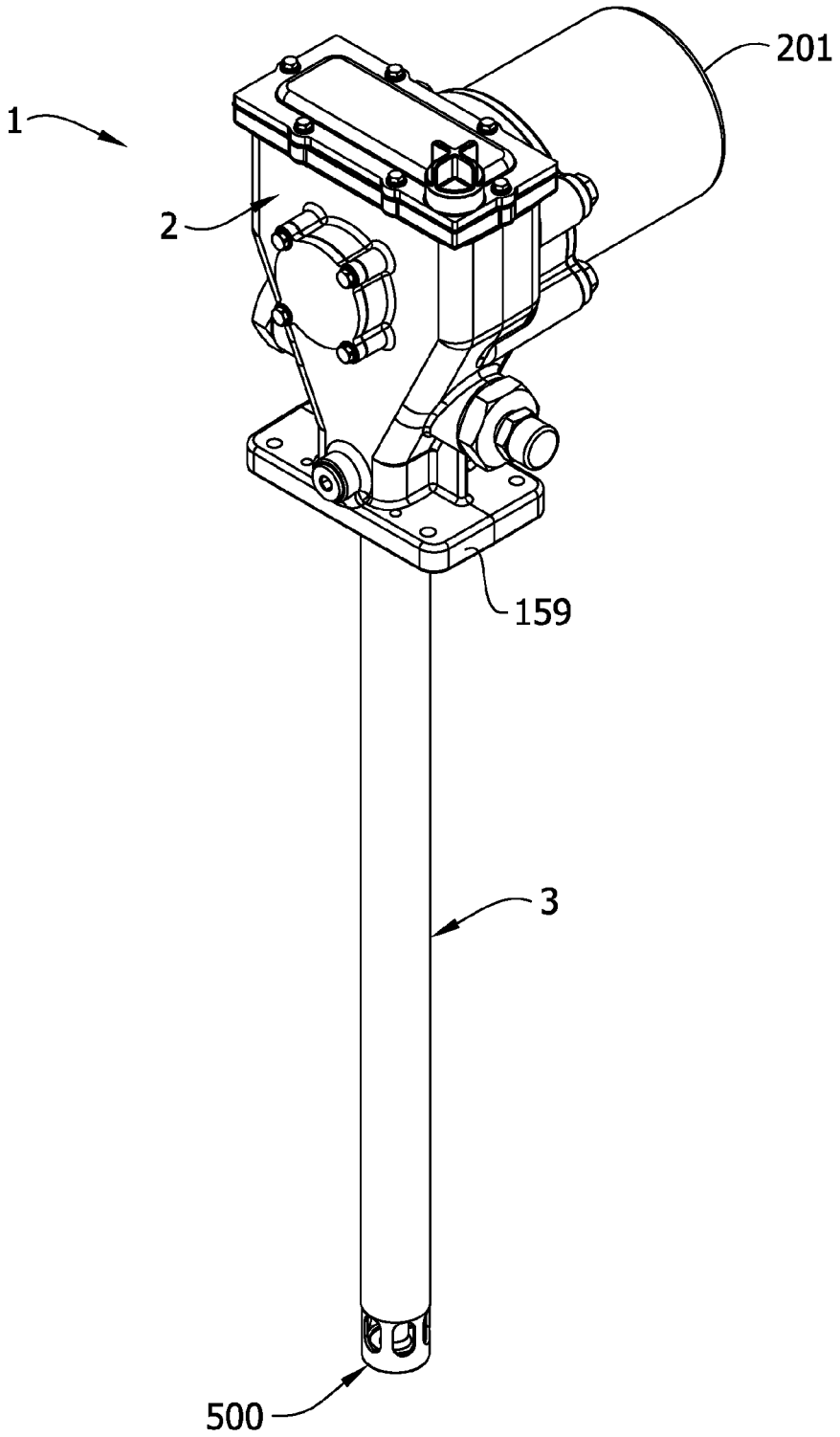
FIG. 1 is a perspective view of a lance pump of this invention.
Figure 2:
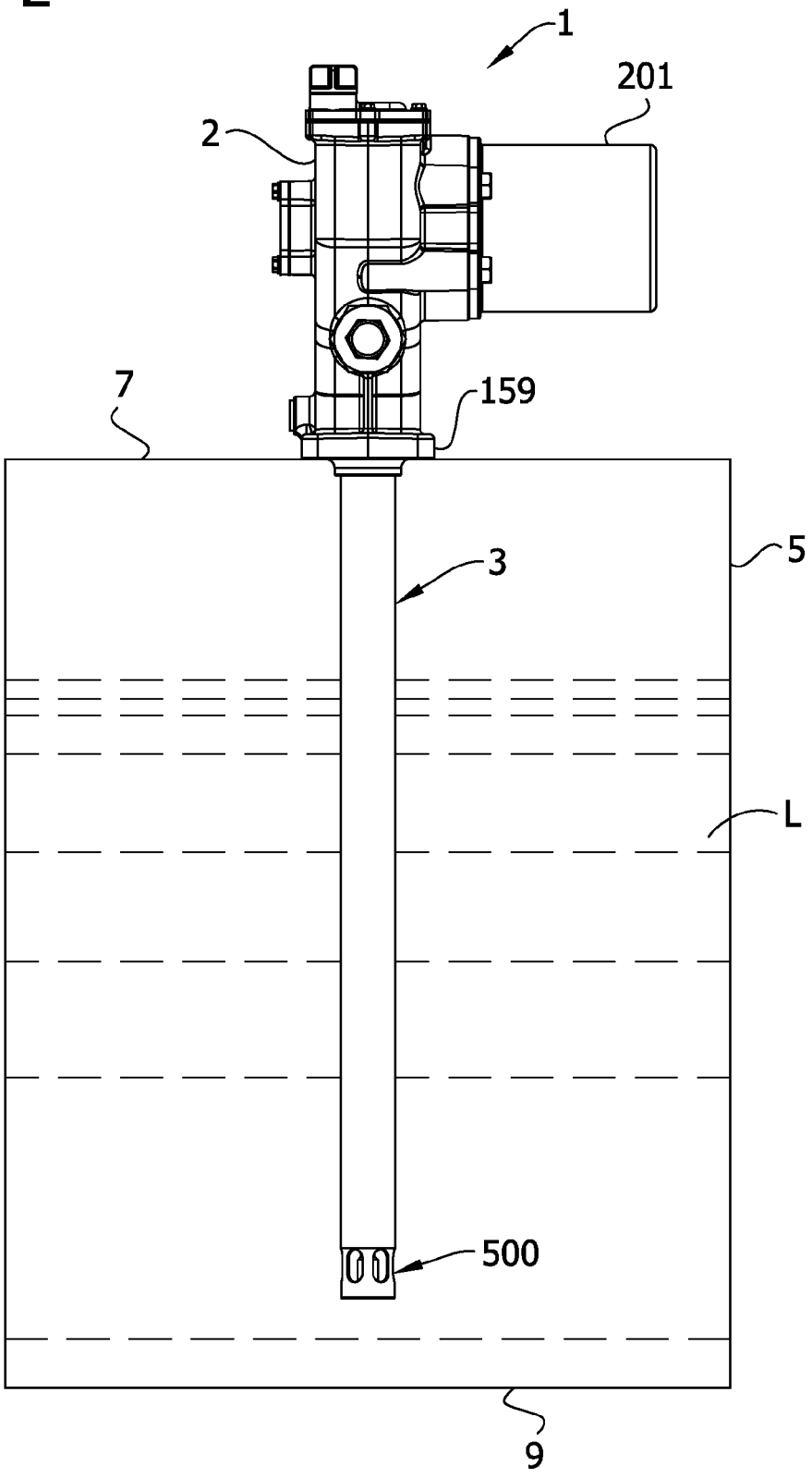
FIG. 2 is a side elevation of the lance pump mounted on a supply of lubricant.
Figure 3:
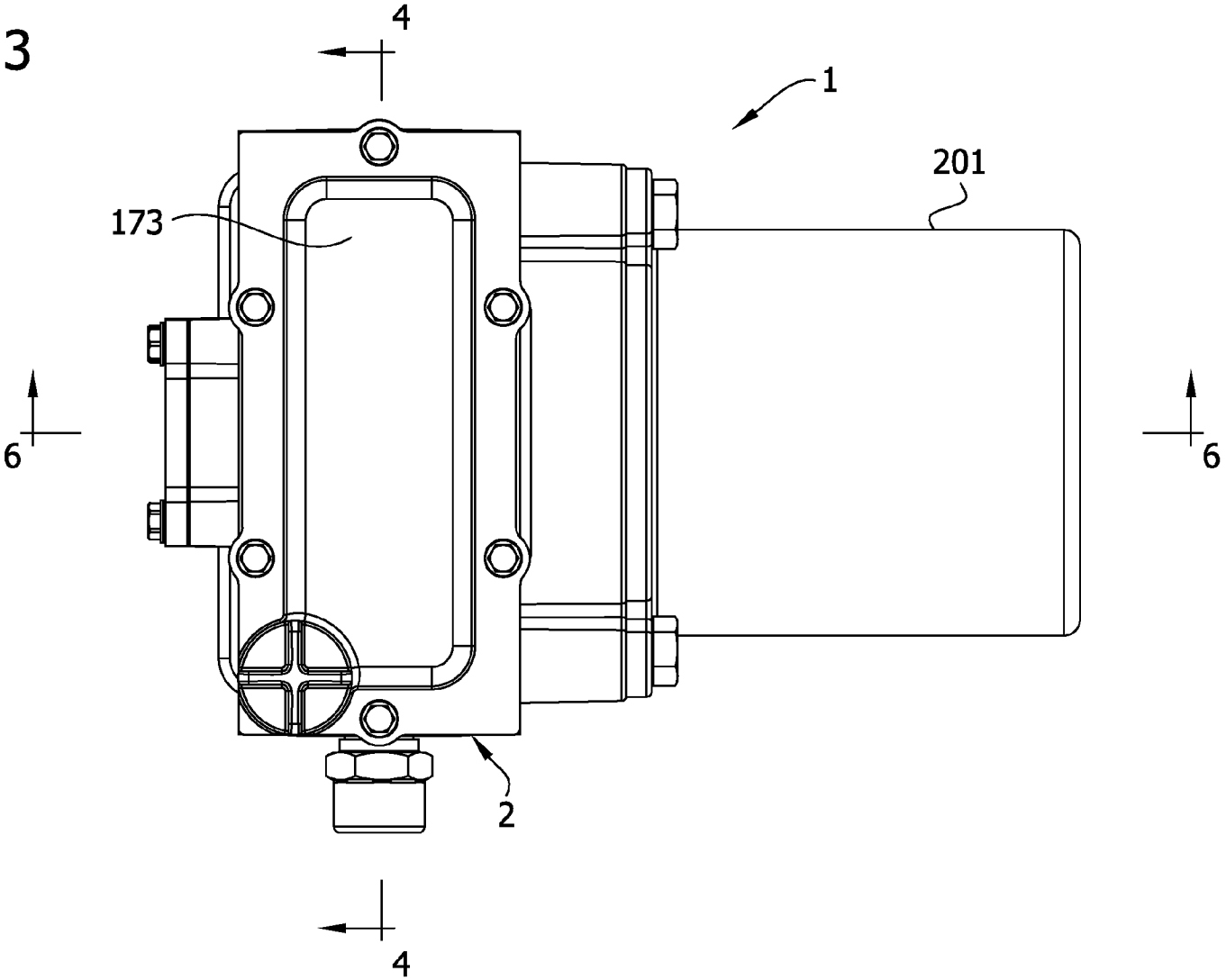
FIG. 3 is a top plan view of the pump in FIG. 1.

Referring to FIGS. 1 and 2, a lance pump of this invention, constructed particularly for pumping lubricant especially grease from a supply thereof, is designated in its entirety by the reference number 1. The pump comprises a hollow head or housing generally designated 2 adapted for placement above the supply, and a lance structure 3 extending down from the head into the supply of lubricant L. As indicated in FIG. 2, the supply may be contained in a container such as a drum 5, the head being mounted on the lid 7 of the drum with the lance structure 3 extending down into the drum generally to the bottom 9 of the container through a hole in the lid. Here it is to be noted that, while the pump 1 has been developed particularly for pumping lubricant and especially grease, it is adapted to pump other pumpable products.

Figure 7:
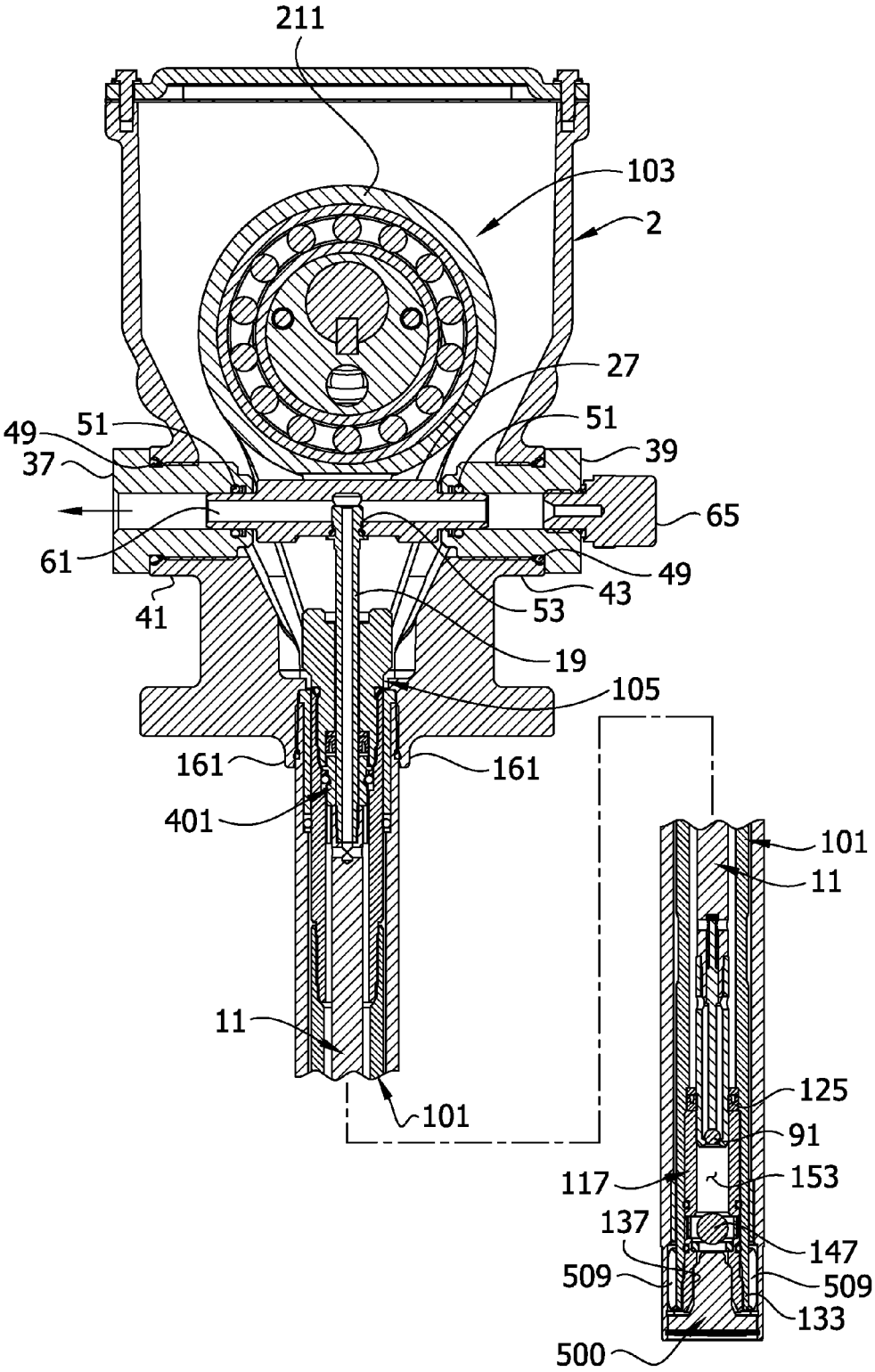
FIG. 7 is a view similar to FIG. 5 but showing the pump tube in a lowered position.
Figure 8:
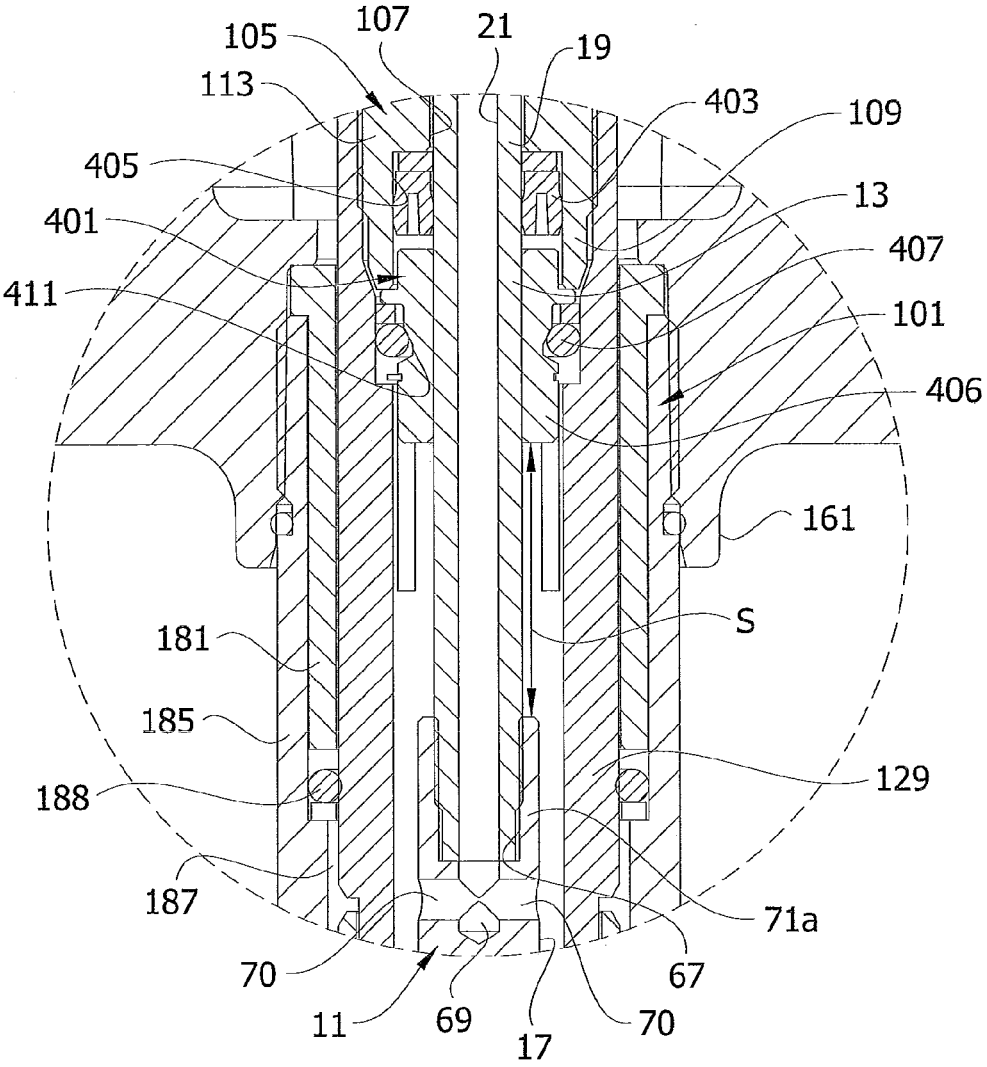
FIG. 8 is an enlarged view of a portion of FIG. 5 illustrating details.

In general, the basic construction and operation of the pump 1 is similar to that of the lance pump described in the aforementioned U.S. Pat. No. 6,102,676, which is incorporated herein by reference. In particular, referring to FIGS. 4-8, the pump comprises an elongate member constituting a pump rod or plunger, designated in its entirety by the reference numeral 11 extending down from the head 2. The plunger has an upper end portion 13, a lower end portion 15 and an intermediate portion 17, these portions being co-linear on the vertical central axis of the lance structure 3. As shown in FIGS. 5 and 8, the upper end portion 13 of the plunger comprises a relatively short tubular element constituted by a tube 19 the bore 21 of which extends all the way from its lower end to its upper end. The latter extends into a pipe 27 extending crosswise of the head. Tube 19 may be referred to as the outlet tube. The cross-pipe 27, which may be referred to as the outlet pipe, has reduced-diameter ends (FIG. 7) fixed in bores of tubular retainers 37, 39 threaded in tubular formations 41, 43 extending horizontally outward from opposite walls of the head 2, the tubular retainers being sealed in the tubular formations 41, 43 by O-rings as indicated at 49. The reduced-diameter ends of the cross-pipe 27 are sealed in the bores of the tubular retainers 37, 39 by O-rings as indicated at 51 in FIG. 7. The upper end of the tubular element or outlet tube 19 is fixed in a vertical opening 53 in the cross-pipe 27 extending up from the bottom of the cross-pipe, this opening 53 terminating short of the top of cross-pipe 27.

The tube 19 has a flange engaging the bottom of the cross-pipe and is sealed in the opening 53 by an O-ring. The bore 21 of tube 19 opens at its upper end to the bore 61 of the cross-pipe for flow of product being pumped (as will appear) up through the bore 21 of tube 19 to the bore 61 of cross-pipe 27 and thence out of bore 61 of cross-pipe 27 to the left as shown by the arrows in FIGS. 5 and 7, the right end of the cross-pipe 27 being plugged as indicated at 65. As particularly illustrated in FIG. 9, the tube 19 has an outside (external) diameter D1 and an overall area A1 in transverse cross section (the entire area bounded by the outer periphery of the tube 19). It has a reduced-diameter lower end portion suitably fixedly received in a cylindrical recess 67 in the upper end 71*a* of the stated intermediate portion 17 of the plunger 11 (see FIG. 8). For outflow of product being pumped into the lower end of the bore 21 (constituting an outlet passage) in the tube 19 and thence upwardly therethrough, the upper end 71*a* of the intermediate portion 17 of the plunger 11 has a short axial passage 69 extending down from the bottom of the recess 67 and lateral ports 70 just below the bottom of the recess 67 for communication from the space (to be subsequently described) surrounding the intermediate portion 17 to passage 69 and thence to the outlet passage 21 in tube 19.

Figure 9:
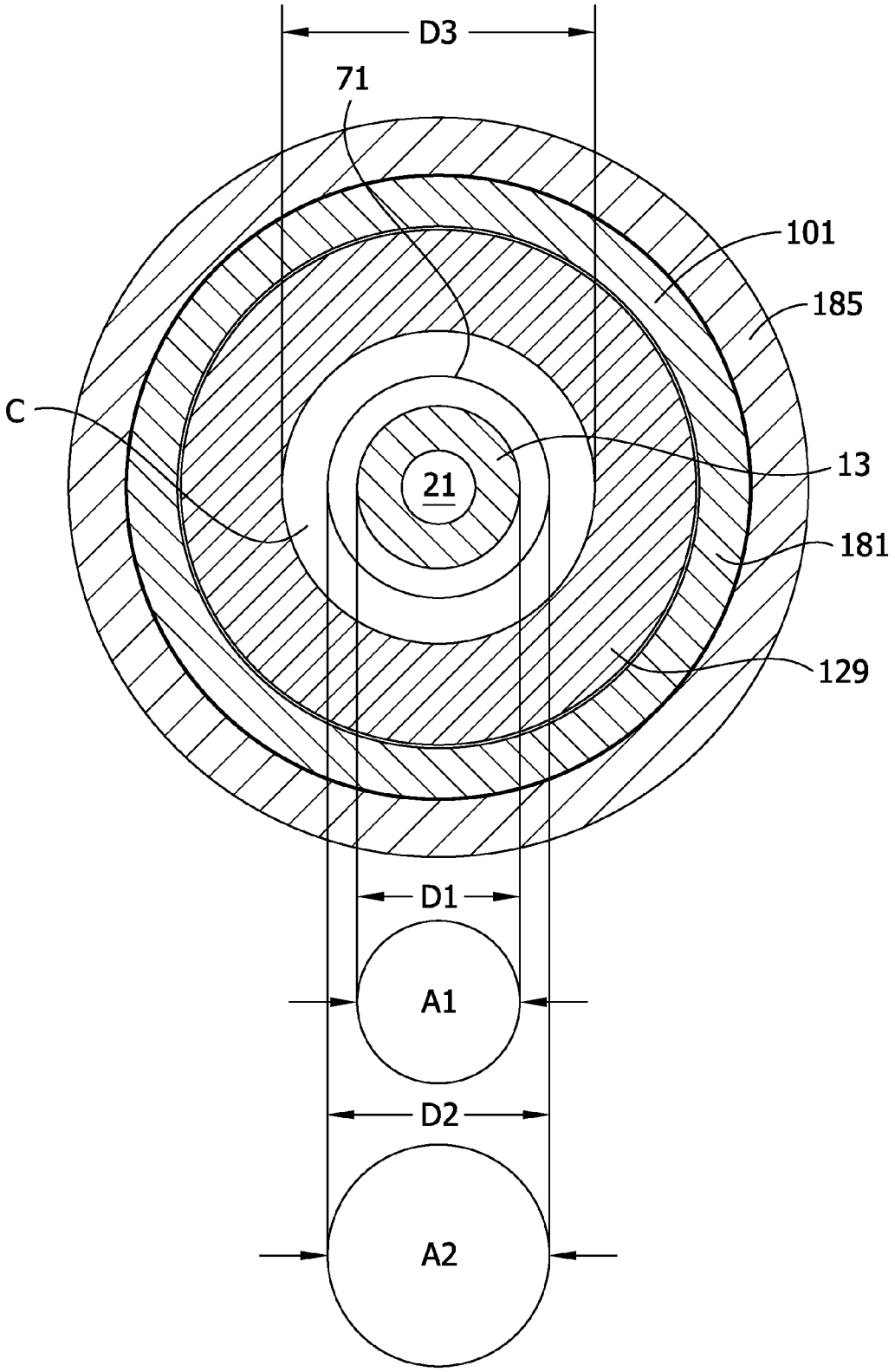
FIG. 9 is an enlarged horizontal section taken in the plane of lines 9-9 of FIG. 5.
Figure 10A:
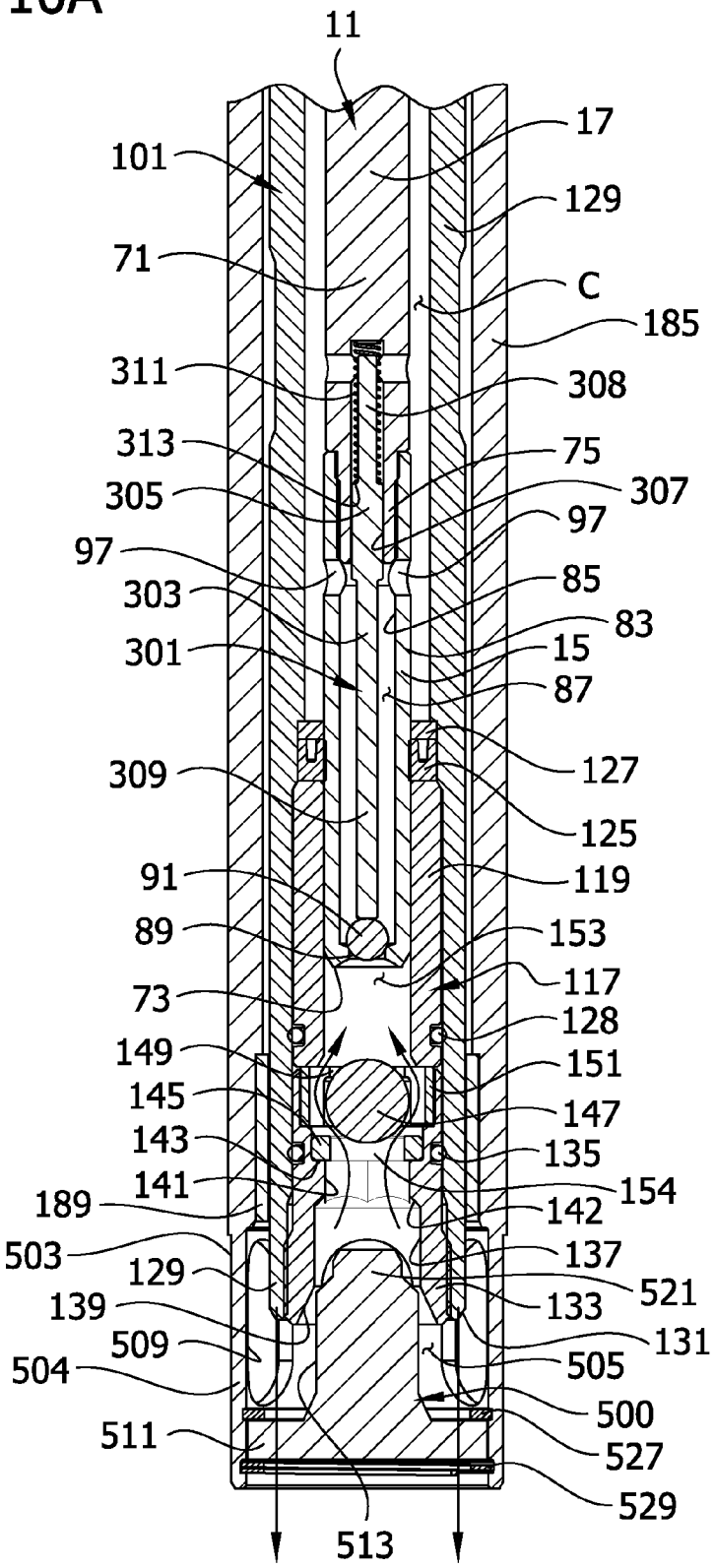
FIGS. 10A-10C are sequential views showing the lower end of the pump tube, a lance structure, and a ram on the lance structure as the pump tube moves between its raised and lowered positions during a downstroke and an upstroke of the pump tube.

Referring to FIGS. 5 and 10A, the intermediate portion 17 of the pump plunger 11 comprises an elongate solid cylindrical plunger member or rod 71 considerably longer than the outlet tube 19. Thus, for example, the entire pump plunger 11 may measure generally 19.15 inches from the upper end of outlet tube 19 to the lower end of the pump plunger 11 indicated at 73, and the tube 19 may measure generally 4.0 inches from its upper end to the upper end at 71*a* of the elongate member 71. In the illustrated embodiment, member 71 per se is of uniform circular cross section with a diameter D2 (see FIG. 9) throughout most of its length extending down from tube 19, and has a lower end extension 75 of reduced diameter.

Referring to FIG. 10A, the stated lower end portion 15 of the pump plunger 11 comprises an elongate cylindrical sleeve 83 surrounding the lower end extension 75 of the solid rod member 71 and having essentially the same external diameter as the diameter D2 of the solid rod member 71. Thus, the external surface of the pump plunger 11 throughout its intermediate portion and lower end portions 17, 15 is cylindrical, i.e., of substantially uniform circular form in transverse cross-section, of diameter D2, with a cross-sectional area A2 (see particularly FIG. 9).

The sleeve 83 has an elongate cylindrical bore 85 extending axially from adjacent its lower end (which is the lower end 73 of the pump plunger 11) to its upper end. The bore 85 has a diameter corresponding to the outside diameter of the lower end extension 75 of the solid rod member 71. The sleeve 83 is secured at its upper end to the extension 75, as by a threaded connection. The sleeve 83 is of such length that its lower end, constituting the lower end 73 of the pump plunger 11, is spaced down from the lower end of the extension 75, being formed at its lower end 73 as a check valve seat with a check valve port 89 (see FIG. 10A) which may be referred to as the inlet port. A ball check valve 91 is biased downwardly against the seat to close the port 89 by a check valve closing element, generally designated 301.

In the illustrated embodiment, the check valve closing element 301 comprises a rod 303 having an upper portion 305 movable up and down in a bore 307 extending up from the lower end of the extension 75, and a lower portion 309 which extends down inside the sleeve 83 and contacts the ball check valve 91. The upper portion 305 of the rod has a close-clearance sliding fit inside the bore 307. The rod 303 is biased in a downward direction to urge the check valve 91 against its seat by a coil compression spring 311 in the bore 307. The spring surrounds a reduced diameter extension 308 of the upper portion 305 of the rod 303 and reacts against a shoulder 313 on the rod. The lower portion 309 of the rod 303 has an outside diameter less than the inside diameter of the sleeve 83 to provide an annular space 87 between the rod and the sleeve. As will become clear, the annular space 87 constitutes a passage for flow of lubricant upwardly therethrough from the inlet port 89 to the upper end of the annular space or passage 87 where the sleeve has lateral ports 97 for lateral exit of lubricant from the passage 87. The upper portion of the bore 307 containing the spring 311 communicates with an elongate annular pump chamber C surrounding the intermediate portion 71 of pump plunger 11 by means of a transverse bore 317 through the pump plunger. This communication facilitates up and down movement of the rod 303 in the bore 307. Placement of the spring 311 in the bore 307 rather than in the annular space 87 facilitates flow of lubricant through the space 87 to the lateral ports 97.

Figure 4:
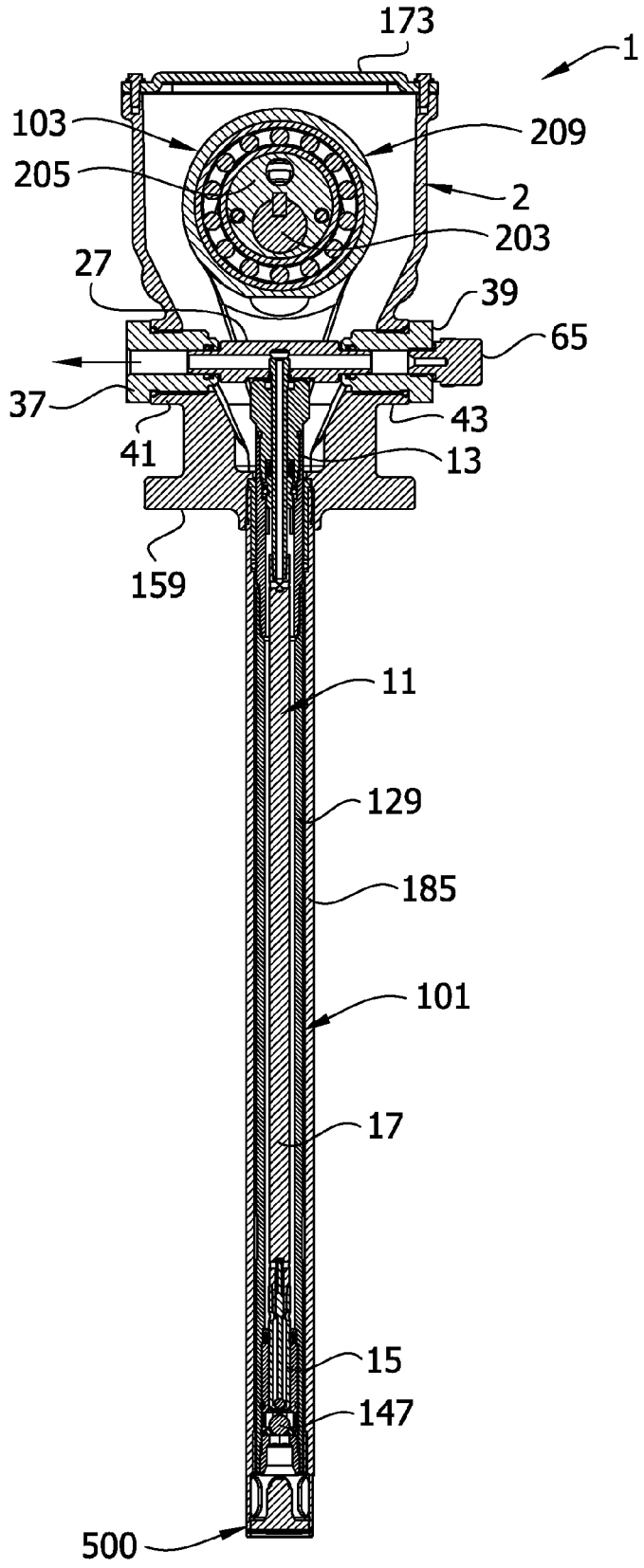
FIG. 4 is a vertical section taken in the plane of lines 4-4 of FIG. 3.
Figure 5:
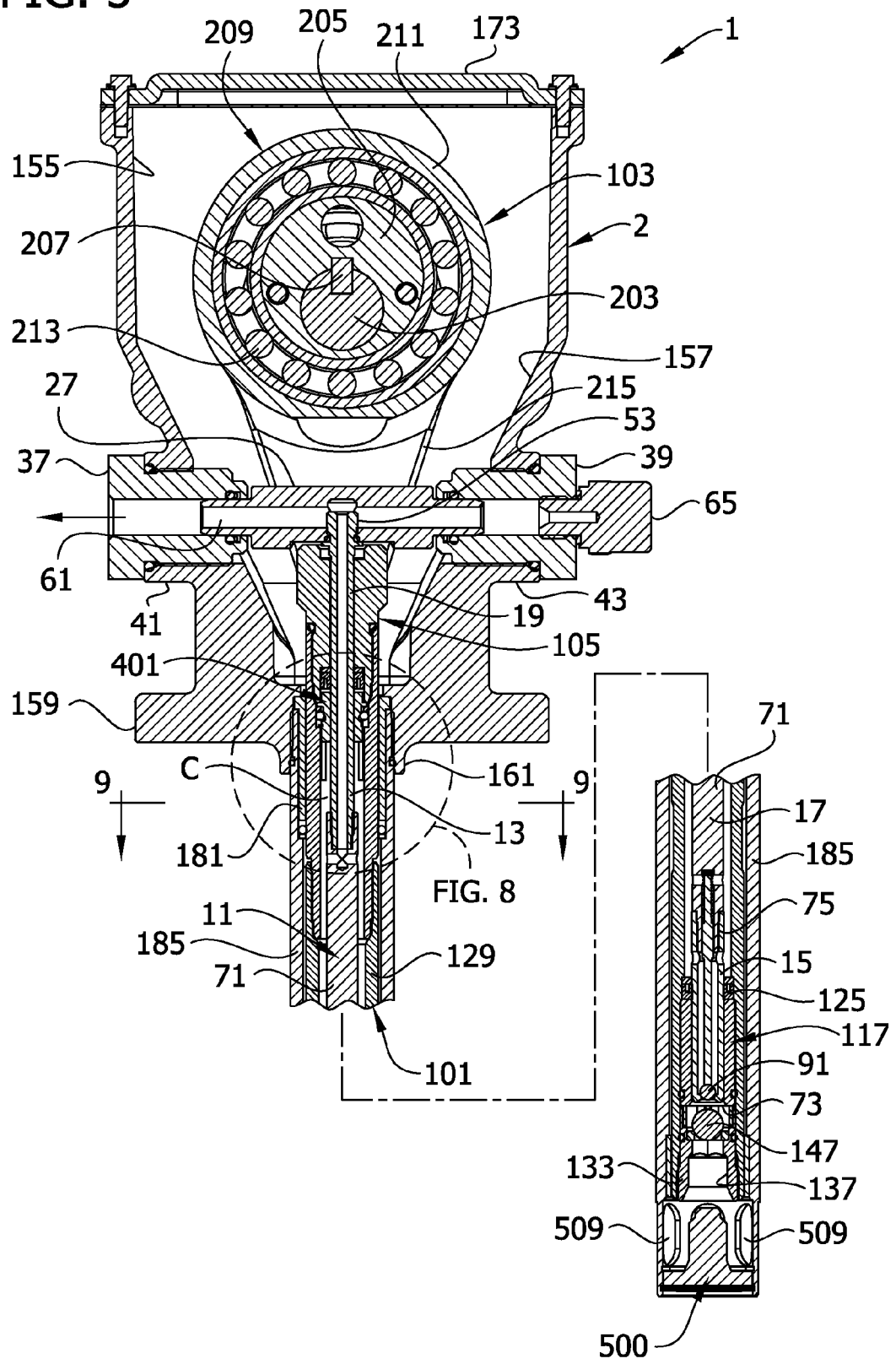
FIG. 5 is an enlarged view of portions of FIG. 4 showing a pump tube of the pump in a raised position.
Figure 6:
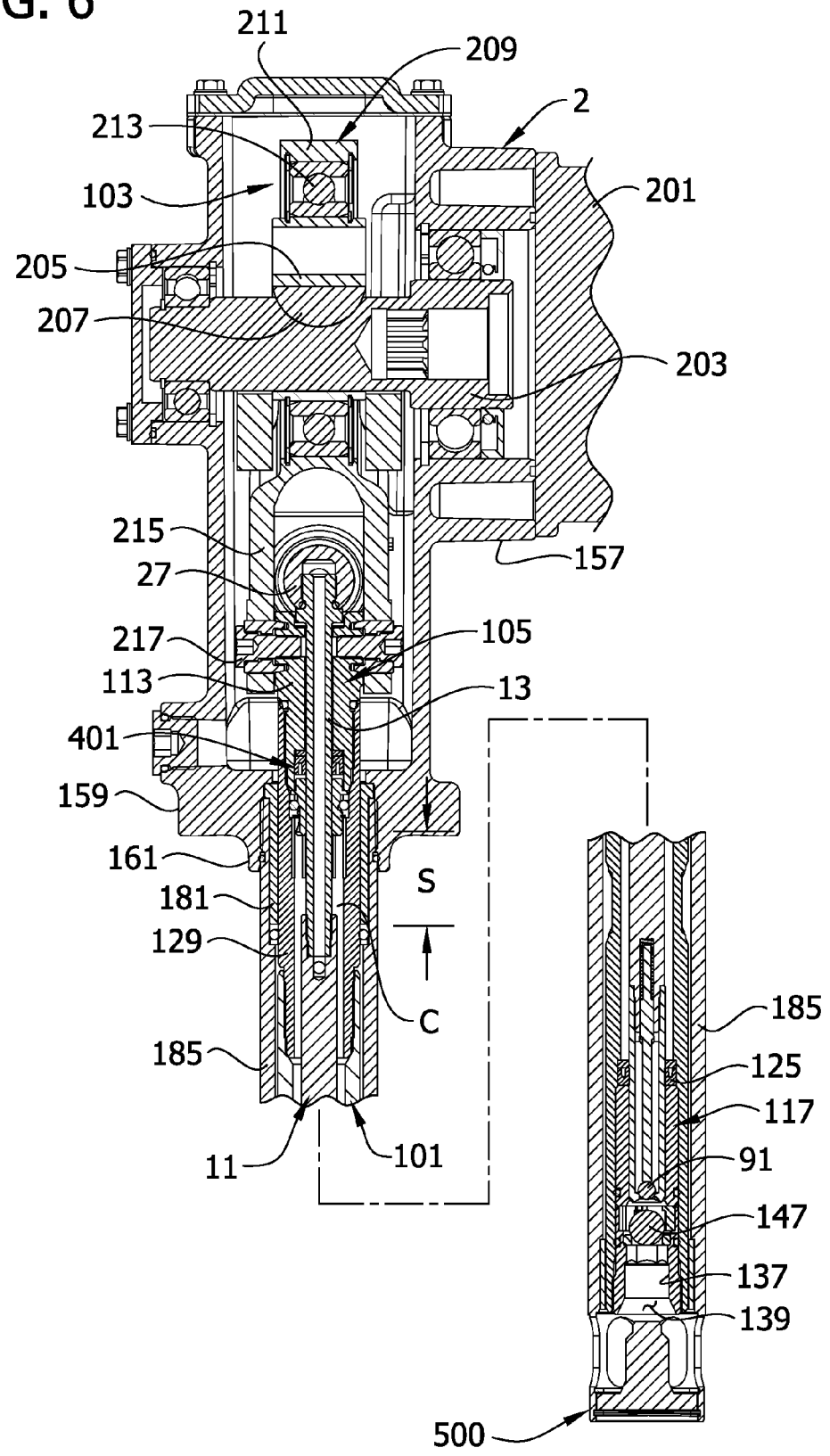
FIG. 6 is a view similar to FIG. 5 but taken in the plane of 6-6 of FIG. 3.

Referring to FIG. 4, an elongate pump tube 101 surrounds the pump plunger 11 and extends down from adjacent the upper end of the pump plunger. A motor-driven mechanism indicated generally at 103 is carried by the head for reciprocating the pump tube 101 through a pump stroke between the raised position relative to the fixed pump plunger 11 in which the pump tube is illustrated in FIGS. 5, 6, and 8, and the lowered position relative to the pump plunger in which it is illustrated in FIG. 7. By way of example, in one embodiment in which the pump plunger 11 is 19.15 inches long from its upper end to its lower end and has a diameter D1 of 0.275 inch and a diameter D2 of 0.390 inch, and in which the pump tube 101 is 18.8 inches long from its upper end to its lower end, and has an internal diameter 0.562 inch, the pump stroke, indicated at S in FIGS. 6 and 8, may be 0.75 inch.

Referring to FIGS. 5-8, the pump tube 101 has an upper end closure indicated in its entirety by the reference numeral 105 slidable up and down on the upper end portion 13 of the pump plunger, i.e., on the outlet tube 19, in sealed relation thereto. This upper end closure 105 has a bore 107 dimensioned for sliding on the tube 19 (see FIG. 8). The upper end closure 105 has a lower portion or stem 109 fixedly fitted in the upper end of the pump tube 101 and an upper head portion 113 on the stem.

Referring to FIG. 8, a double seal, generally designated 401, is provided adjacent the upper end closure 105 for sealing the upper end of the pump tube 101. The double seal comprises an upper seal 403 received in a bore 405 extending up from the lower end of the stem 109 of the closure 105. The seal 403 surrounds the outlet tube 19 of the plunger 11 and seals against both the stem 109 and the outlet tube. In the illustrated embodiment, the upper seal 403 is a cup seal slidable on the outlet tube 19. The double seal also includes a metal bushing 406 around the outlet tube 19 below the stem 109 of the upper end closure 105. A lower seal 407 is carried by the bushing and seals against the pump tube 101 at a location below the upper seal 403. In the illustrated embodiment, the lower seal 407 is an O-ring seal seated in an annular groove 411 in the outer surface of the bushing 406. Other double seal arrangements are possible.

Referring to FIG. 10A, the pump tube 101 has a lower closure indicated in its entirety by the reference numeral 117 slidable up and down on the lower end portion 15 (sleeve 83) of the pump plunger 11 and closing the pump tube above the lower end of the pump tube. This closure 117 comprises an elongate generally cylindrical tubular member 119 fixedly fitted in the pump tube adjacent but spaced above the lower end of the pump tube. A seal constituted by a ring 125 of elastomeric material is provided at the upper end of closure member 119, the ring being held thereon by a retainer as indicated at 127. The ring 125 surrounds the sleeve 83, being slidable thereon in sealed relation thereto, and may be a cup seal as shown (of U-shape in cross section in a radial plane). An O-ring seal is indicated 128 surrounding the lower portion of the tubular member 119. The pump tube 101 is of larger internal diameter D3 and larger internal cross-sectional area than the pump plunger 11 throughout the length of the pump tube between its upper and lower end closures 105 and 117 thereby defining the aforementioned pump chamber C between the surface of the fixed pump plunger 11 and the interior surface of the pump tube extending from the upper closure to the lower closure. The pump tube 101 is of such length relative to the pump plunger 11 as to extend down below the lower end 73 of the pump plunger 11 not only in its lowered position (FIG. 7) but also in its raised position; and is desirably of larger internal cross-section than the cross-section of portions 17 and 15 of the pump plunger 11 throughout the length thereof.

Figure 10B:
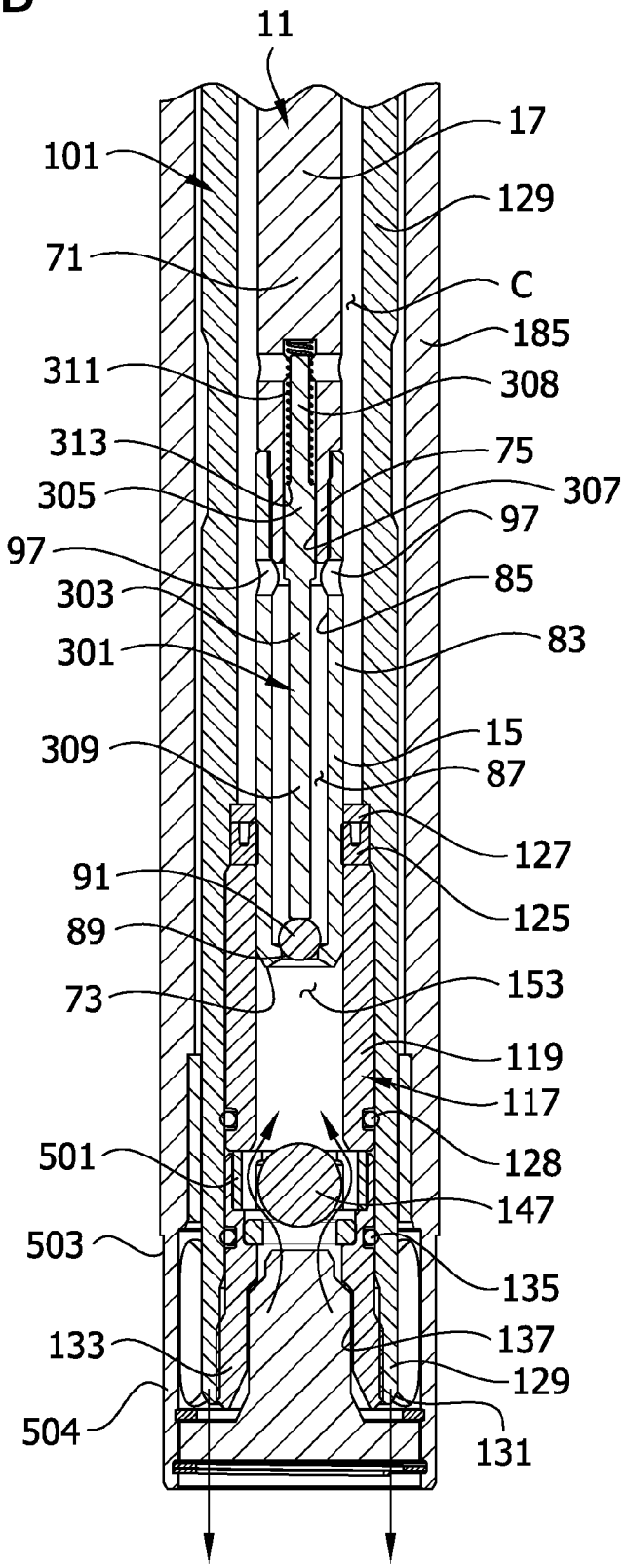
Figure 10C:
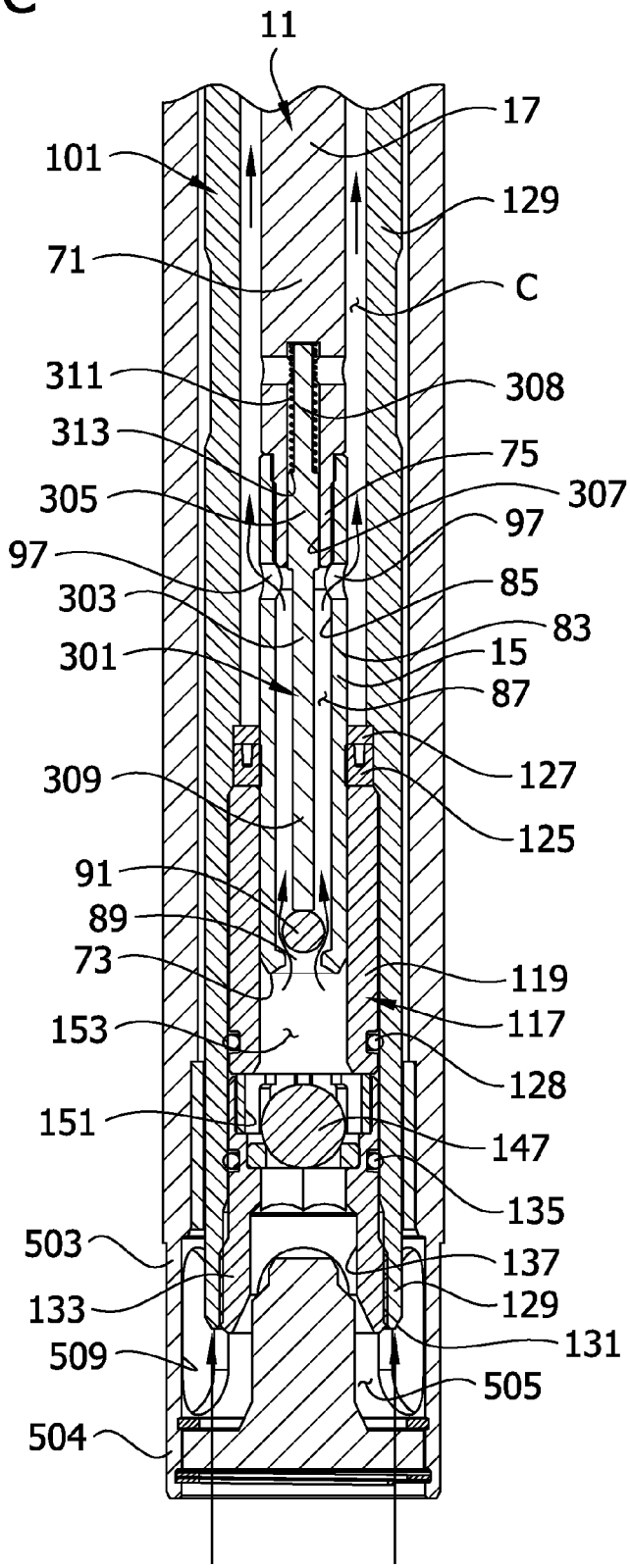

The pump tube 101 comprises an elongate tubular member 129 which, in its raised position shown in FIGS. 5, 6, and 8 extends all the way down from its upper end closure 105 to and for some distance below the lower end of the lower closure member 119, the lower end of the member 129 being indicated at 131 in FIGS. 10A-10C. Fitted in the lower end portion of tubular member 129 is a tubular cylindrical check valve fitting 133. This fitting is fixed in the lower portion of tubular member 129 with an O-ring seal as indicated at 135 and extends down out of the lower end 131 of member 129, having a passage 137 extending up from its lower end, where it is open as indicated at 139. Passage 137 has a throat 141 of reduced diameter forming a downward facing tapered shoulder 142 and an upward-facing internal annular shoulder 143 on which is provided an annular valve seat 145 for a ball check valve 147 constituting an inlet check valve (see FIG. 10A). The valve seat 145 and the ball 147 occupy an upwardly opening recess 149 in the upper end of the fitting 133, the ball being retained in the recess by a retainer 151 fixed on the upper end of the fitting 133. The ball retainer is formed as shown in FIG. 10A to allow the ball to move up off the ball seat 145 and provide for flow of lubricant up around the ball to the space in the pump tube 101 below the lower end at 73 of the fixed plunger 11, said space constituting an expansible and contractible lower end chamber 153. The opening or inlet port 154 in the ball seat 145 has an area at least 70% of the cross-sectional area of the pump plunger 11 at the lower end 73 of the pump plunger, i.e. at least 70% of area A2, for the purpose of reducing the pressure drop across the seat 145.

Referring to FIG. 5, the head 2 has an upper portion 155 of generally rectangular shape in horizontal section and a lower portion 157 tapering down toward its lower end where it has an outwardly extending flange 159 serving as a base for mounting the head on the lid 7 of a drum 5 (see FIG. 2) containing lubricant with the lance structure 3 of the pump extending down through a hole in the lid generally to the bottom of the drum. The head 2 further has a bottom part 161 having a central circular opening therein. The head 2 is closed at the top by a top plate 173 secured to the walls of the head.

The pump tube 101 extends down from within the tapered lower portion 157 of the head through the opening in a bottom part 161 of the lower portion. The pump tube 101 is slidable in a bronze brushing 181 lodged the upper end of an elongate tubular casing 185 constituting part of the lance structure 3 which extends down from the head 2 surrounding the pump tube 101 generally all the way down to a level just above the lower end 131 of the pump tube when the pump tube is in its raised position at the upper end of its stroke S in which it is illustrated in FIGS. 5 and 8. The casing 185 is of somewhat larger internal diameter than the external diameter of the pump tube so that there is an elongate annular space 187 therebetween (see FIG. 8). At 188 is indicated an O-ring seal at the upper end of the tubular casing 185. As shown in FIG. 10A, the pump tube 101 (more particularly the elongate tubular member 129) is sealingly slidable in a bronze bushing 189 fixed in the lower end of the tubular casing 185. The bushing 189 functions as a guide for the pump tube, and it also functions as a seal blocking entry of lubricant into the space 187 between the pump tube 101 and the casing 185.

Referring to FIGS. 1, 5, and 6, a motor 201 mounted on a side wall of the head 2 has a rotary output shaft 203 extending horizontally across the head. The motor-driven mechanism 103 for reciprocating the pump tube 101 up and down through its pump stroke S comprises a rotary-to-reciprocating mechanism interconnecting the rotary output shaft 203 and the upper end of the pump tube 101. In detail (FIGS. 5 and 6), this mechanism is shown to comprise an eccentric 205 keyed on the shaft 203 as indicated at 207 within the head 2 and rotary with the shaft on the horizontal axis of the shaft. The eccentric 205 comprises a circular disk eccentrically mounted on the shaft. By way of example but not limitation, the motor 201 is a rotary hydraulic motor. The rotary-to-reciprocating mechanism further comprises a follower 209 comprising a ring 211 surrounding the eccentric 205 with a ball bearing 213 therebetween, and an arm 215 in the form of a yoke or fork extending from the ring straddling the cross-pipe 27 and pin-connected as indicated at 217 (FIG. 6) to the upper end of the head portion 113 of the upper end closure 105 of the pump tube 101. The eccentric/follower mechanism 205/209 is such that on rotation of the eccentric through each revolution thereof, the follower 209 is raised and lowered (it also oscillates back and forth as permitted by the pin connection 217) to reciprocate the pump tube 101 linearly up and down through pump stroke S, as determined by the throw of the eccentric (for example, 0.75 inch).

As clear from the above and from the drawings, the outside diameter D2 of the intermediate and lower portions 17, 15 of the pump plunger 11 is greater than the outside diameter D1 of the outlet tube 19 (the upper end portion of the pump plunger 11), and the overall cross-sectional area A2 of the intermediate and lower portions 17, 15 of the pump plunger is greater than the overall cross-sectional area A1 of the outlet tube 19 (see FIG. 9). More specifically, D2 and D1 are such that the area A2 may be, for example, twice as large as area A1 (e.g., D2 may be 0.390 inch, D1 may be 0.275 inch, area A2 thereby being 0.120 square inches and area A1 being 0.060 square inches).

In accordance with this invention, a ram, generally designated 500, is provided at a lower end of the lance structure 3 for forcing lubricant up into the lower end of the pump tube 101 past the inlet check valve 147 on a downstroke of the pump tube 101. As illustrated in FIGS. 10A-10C and 11, the tubular casing 185 of the lance structure 3 has a lower end section 503 comprising a tubular wall extending 504 down below the lower end of the pump tube 101 and defining an inlet chamber 505 for receiving pumpable product from the supply of lubricant L. The lower end section 503 has at least one large opening 509, and desirably multiple large openings, for allowing free flow of pumpable product from the supply into the inlet chamber 505.

Figure 11:
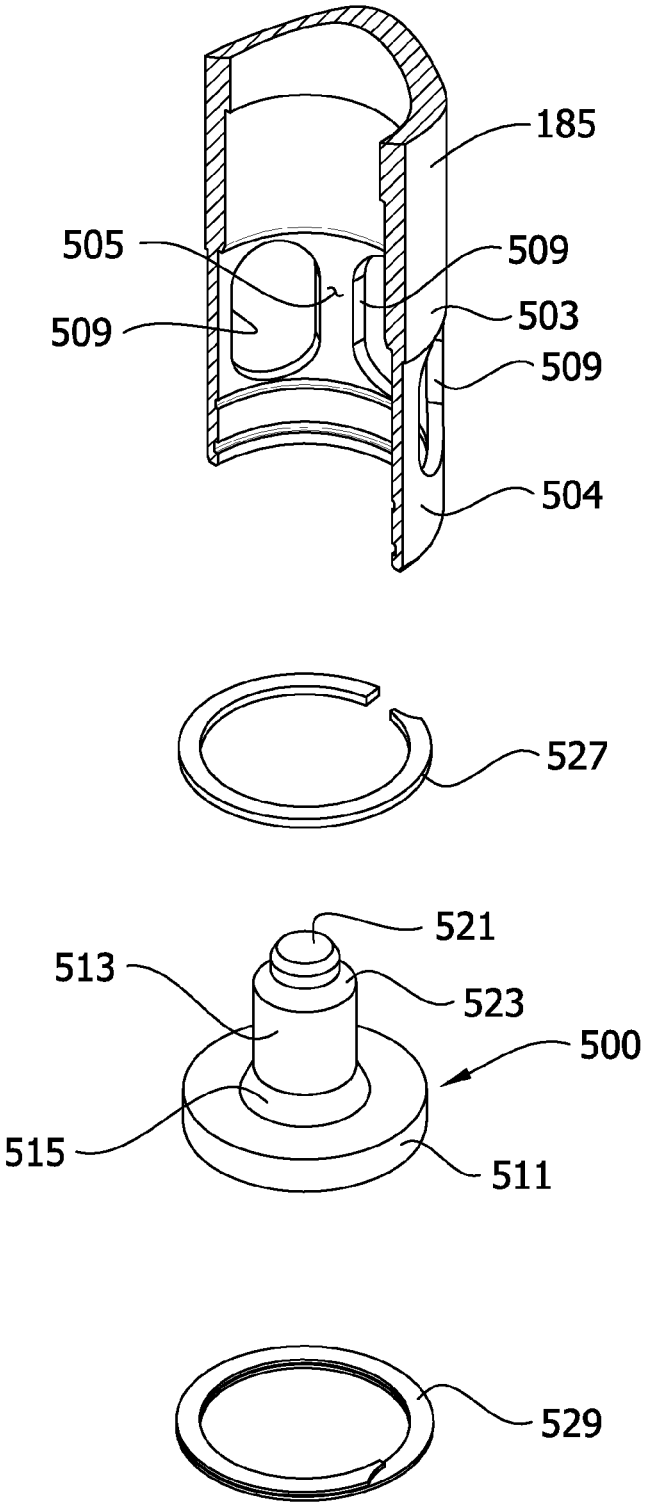
FIG. 11 is an exploded perspective showing a lower end section of the lance structure, the ram, and related components.

Referring to FIGS. 10A and 11, the ram 500 is positioned inside the inlet chamber 505 defined by the lower end section 503 of the tubular casing. The ram 500 comprises a generally circular base 511 configured for a close conformance fit inside the tubular wall 504 of the lower end section 503 of the tubular casing 185, generally adjacent a lower end of the wall 504. The ram also includes a generally cylindrical body 513 having a tapered lower portion 515 connecting the body to the base 513, and a generally cylindrical head 521 of reduced diameter connected to the body by an inclined upward-facing shoulder 523.

The ram 500 is sized and shaped such that when the pump tube 101 is in its raised position as shown in FIGS. 5 and 6, lubricant is free to flow from the supply into the inlet chamber 505 into the space surrounding the body 513 and head 521 of the ram, and thence upward past the head 521 into the passage 137 of the check valve fitting 133 to fill the space below the inlet ball check valve 147. The ram 500 is further sized and shaped such that when the pump tube 101 is in its lowered position as shown in FIGS. 7 and 10B, the generally cylindrical body 513 of the ram 500 has a relatively close circumferential fit in the passage 137 of the check valve fitting 133, and the head 521 of the ram has a somewhat looser circumferential fit in the throat 141 of the passage 137. The upward-facing shoulder 523 of the ram is contoured to mate with the downward-facing shoulder 142 in the passage 137 immediately below the throat 141.

As illustrated, the ram 500 is integrally formed as a single part, but it will be understood that that it may comprise separate parts. Other ram configurations are also possible.

Referring again to FIGS. 10A-10C and 11, the ram 500 is held in position in the lower end section 503 of the tubular casing 185 by an upper retaining ring 527 overlying the base 511 of the ram and by a lower retaining ring 529 underlying the base. The retaining rings 527, 529 have outer peripheral edges received in annular grooves in the tubular wall 504 of the lower end section 503 of the casing 185. Desirably, the lower retaining ring 529 is a resiliently compressible helix ring that holds the ram 500 tightly between the two rings 527, 529 to prevent rattling of the ram in an axial direction. If necessary or desired, the ram 500 can be removed from the pump casing 185 by removing the lower retaining ring.

The pump 1 is operable in cycles, each occurring on a revolution of the eccentric 205, and each of which may be regarded as starting with the pump tube 101 in its uppermost raised position at the upper end of its stroke S shown in FIGS. 5, 6, and 8 as a result of the eccentric being at that point in a revolution thereof where its high point is uppermost and its low point is down. With the pump tube 101 in its stated raised position, the double seal 401 of its upper end closure 105 is in the raised position in which it appears in FIGS. 5, 6 and 8 a distance approximately equal to or somewhat greater than the distance S above the upper end 71*a* of member 71, and the seal 125 of its lower closure 117 is in the raised position in which it appears in FIGS. 5 and 6 a distance greater than S above the lower end 73 of the plunger 11. Chamber C is fully charged with lubricant as a result of the preceding cycle (as will be described). The inlet check valve ball 147 is in its fully raised position in close proximity to the lower end 73 of the plunger and the lower chamber 153 is in its fully contracted state. As illustrated in FIGS. 5 and 6 the ball check 91 is closed. Passage 87 is full of lubricant, check valve ball 91 being closed down on its seat as illustrated in FIGS. 5 and 6. On rotation of the eccentric 205 from its FIG. 5 position, the pump tube 101 is driven downward, its lower end including the check valve fitting 133 plunging down into the lubricant L. As illustrated in FIG. 7, chamber 153 expands; the ball check 147 opens for entry of lubricant to fill the chamber 153 as it expands and creates a suction for drawing lubricant into the chamber 153; and the ball check 91 remains closed.

As the pump tube is driven down through its downstroke, a portion of the outlet tube 19 (constituting the upper end portion of the plunger 11) equal in length to the pump stroke S is, in effect, withdrawn from the pump chamber C and a portion of the lower end portion of the plunger equal in length to the pump stroke S is, in effect, entered in the pump chamber. Thus, a volume equal to the pump stroke times the cross-sectional area A1 of the tube 19 (S×A1) is withdrawn from the pump chamber and a volume equal to the pump stroke times the cross-sectional area A2 of the lower end portion of the plunger (S×A2) is entered in the pump chamber, to the effect that a volume of lubricant equal to S×A2 minus S×A1 is delivered through the passage 21 in tube 19 to the outlet pipe 27. Since A2=2A1, the volume discharged from the pump chamber C equals S×A1, that is, the length of the pump stroke S times the cross-sectional area A1 of the upper end portion 19 of the plunger 11.

As the eccentric 205 rotates through the first half of a revolution from its FIG. 5 position to its FIG. 7 position, the pump tube 101 moves down through its downstroke. As the pump tube moves down relative to the stationary lance structure, the lower end of the pump tube moves down through the lubricant in the inlet chamber 505 defined by the lower end section 503 of the tubular casing 185, and the ram 500 moves up into the lower end of the pump tube to push lubricant from the inlet chamber up into the pump tube past the inlet check valve 147 and into the lower chamber 153. The downward movement of the pump tube 101 and the upward movement of the ram 500, particularly in the case where the lubricant is a relatively stiff grease (e.g., a thick heavy viscous grease), expedites the loading of the lower chamber 153 which, at the lower end of the downstroke of the pump tube is expanded to its full extent as shown in FIGS. 7 and 10B and completely filled with lubricant.

As the eccentric 205 rotates through the second half of a revolution, i.e. from the point where its high point is down and its low point is up as shown in FIG. 7 back to the point where its high point is up and its low point is down as shown in FIG. 5, it pulls the pump tube 101 back up through an upstroke of length S. As the pump tube 101 moves up, the lower ball check 147 closes, and lubricant is forced up from chamber 153, opening the check valve 91 as shown in FIG. 10C, and lubricant is delivered from chamber 153 through passage 87 and ports 97 to the pump chamber C. Also, as the pump tube 101 moves up, a portion of the length of the outlet tube 19 (constituting the upper end portion of the plunger 11) equal to the stroke S is in effect re-entered in the pump chamber C and a portion of the length of the lower end portion of the plunger 11 equal to the stroke S is in effect withdrawn from the pump chamber. Thus, a volume equal to the pump stroke S times the cross-sectional area A1 of tube 19 (S×A1) enters the pump chamber C. In addition, a volume equal to S×A2 is transferred from chamber 153 to pump chamber C through passage 89 to the effect that a volume of lubricant equal to S×A2 minus S×A1 is delivered through passage in tube 19 to the outlet pipe. Here again, since A2=2A1, the volume discharged from the pump chamber equals S×A1 (the same as on a downstroke). The chamber 153, which may be referred to as the intake chamber, is at least 85% exhausted on the upstroke, i.e., it is unswept no more than 15%, to take care of use of the pump to pump grease having air in it. With the intake chamber 153 unswept less than 15%, reduction of pump output which might otherwise be caused because of air in the grease is avoided.

Upward movement of the pump tube 101 also results in movement of the ram 500 out of the passage 137 of the check valve fitting 153 toward the position shown in FIGS. 5 and 6 in which lubricant is free to flow from the supply into the inlet chamber 505. This flow is facilitated by the relatively large open area provided by the one or more openings 509 in the tubular wall 504 of the lower end section 503 of the casing 185.

The pump as above described with the fixed plunger 11 and reciprocal pump tube 101 is capable of reliable operation at relatively high speed, e.g. 600 cycles (600 strokes of the pump tube) per minute, even with heavy viscous grease at low temperatures. It is operable with a relatively short stroke, e.g. a 0.75 inch stroke as above noted, and acts to deliver a metered volume S×A1 of lubricant on each downstroke as well as on each upstroke of the pump tube.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A lance pump for pumping a pumpable product from a supply thereof, said pump comprising:

a head adapted for placement above said supply;

an elongate member constituting a plunger extending down from the head having an upper end and a lower end;

said plunger being fixed at its upper end with respect to the head;

an elongate tube surrounding the plunger extending down from adjacent the upper end of the plunger to and below the lower end of the plunger and reciprocable up and down through a pump stroke relative to the plunger;

a motor-driven mechanism associated with the head for reciprocating the tube through said pump stroke between a raised position relative to the plunger and a lowered position relative to the plunger;

said tube having an upper end closure slidable up and down on an upper portion of the plunger;

said tube having a lower end closure slidable up and down on a lower portion of the plunger;

an elongate annular pump chamber between the plunger and the tube;

said tube having an inlet check valve adjacent an open lower end of the tube and below a lower end of the plunger defining in conjunction with the lower end of the plunger an expansible and contractible lower end chamber;

the inlet check valve opening on a downstroke of the tube for entry of the pumpable product to said lower end chamber;

said plunger having a first passage for outflow of pumpable product from said elongate annular pump chamber to and through an outlet in the head on a downstroke and also on an upstroke of the tube;

said plunger having a second passage with a check valve therein adapted to open on each upstroke of the tube with the inlet check valve closed for delivery of pumpable product from said lower end chamber to said elongate annular pump chamber;

a tubular lance structure affixed to the head and surrounding the tube; and a ram attached to a lower end of the lance structure, said ram being positioned and oriented to enter into the open lower end of the tube on each downstroke of the tube to force lubricant up into the tube past said inlet check valve and to withdraw from the open lower end of the tube on each upstroke of the tube.

2. A lance pump as set forth in claim 1, wherein the tubular lance structure comprises a lower end section extending down below the tube and defining an inlet chamber for receiving pumpable product from said supply, and at least one opening in the lower end section allowing flow of pumpable product from the supply into the inlet chamber.

3. A lance pump as set forth in claim 2, wherein the ram is positioned in said inlet chamber.

4. A lance pump as set forth in claim 3, wherein the lower end section of the tubular lance structure comprises a tubular wall, and wherein the ram comprises a base adjacent a lower end of the tubular wall, and a body extending up from the base toward the open lower end of the tube.

5. A lance pump as set forth in claim 4, wherein the ram body is sized for a close circumferential fit inside said second passage of the tube.

6. A lance pump as set forth in claim 5, wherein said second passage comprises a throat of reduced diameter, and wherein the ram comprises a head of smaller diameter than the ram body and sized to fit inside said throat.

7. A lance pump as set forth in claim 1, further comprising an inlet check valve closing element movable relative to the plunger, and a spring urging the inlet check valve closing element to a position closing the inlet check valve.

8. A lance pump as set forth in claim 7, wherein said inlet check valve closing element comprises a rod having an upper portion movable in a bore in the plunger, and a lower portion contacting the inlet check valve.

9. A lance pump as set forth in claim 8, wherein said spring surrounds the upper portion of the rod.

10. A lance pump as set forth in claim 1, wherein said tube has an upper end closure slidable up and down on an upper portion of the plunger adjacent the upper end of the plunger, and a double seal around the upper portion of the plunger adjacent the upper end closure for sealing the upper end of the tube.

11. A lance pump as set forth in claim 10, wherein said double seal comprises an upper seal around the plunger sealing against the pump tube, a bushing around the pump seal below the upper seal, and a lower seal carried by the bushing and sealing against the pump tube at a location below the upper seal.

12. A lance pump as set forth in claim 1, wherein the tubular lance structure comprises a lower end section extending down below the tube and defining an inlet chamber for receiving pumpable product from said supply.

13. A lance pump as set forth in claim 12, wherein the lower end section of the tubular lance structure comprises a tubular wall, and wherein the ram is positioned inside the tubular wall.

14. A lance pump as set forth in claim 13, further comprising at least one opening in the tubular wall allowing flow of pumpable product from the supply into the inlet chamber.

* * * * *